US005746017A

United States Patent [19]

Marvik

[11] Patent Number: 5,746,017

[45] Date of Patent: May 5, 1998

[54] PLOUGHSHARE

[75] Inventor: Jostein Marvik, Tau, Norway

[73] Assignee: Scana Staal AS, Norway

[21] Appl. No.: 727,389

[22] PCT Filed: Apr. 5, 1995

[86] PCT No.: PCT/NO95/00061

§ 371 Date: Oct. 10, 1996

§ 102(e) Date: Oct. 10, 1996

[87] PCT Pub. No.: WO95/28526

PCT Pub. Date: Oct. 26, 1995

[30] Foreign Application Priority Data

Apr. 13, 1994 [NO] Norway ..... 941320

[51] Int. Cl.[6] ..... E01H 5/04

[52] U.S. Cl. ..... 37/446; 37/233

[58] Field of Search ..... 37/231, 233, 236, 37/266, 460, 446; 172/701.1, 701.2, 701.3, 772, 772.5

[56] References Cited

U.S. PATENT DOCUMENTS

| | | | |
|---|---|---|---|
| 2,061,585 | 11/1936 | Meyer | 37/233 |
| 3,477,149 | 11/1969 | Wagner | 37/233 |
| 4,347,677 | 9/1982 | Küper | 37/233 |
| 4,590,694 | 5/1986 | Block | 37/233 |
| 5,471,770 | 12/1995 | Ferreira | 37/233 X |

FOREIGN PATENT DOCUMENTS

| | | |
|---|---|---|
| 24 00 440 A1 | 7/1975 | Germany . |
| 33 19 223 A1 | 7/1984 | Germany . |
| 38 14 240 A1 | 11/1989 | Germany . |
| 454 279 | 4/1988 | Sweden . |

*Primary Examiner*—Terry Lee Melius
*Assistant Examiner*—Robert Pezzuto
*Attorney, Agent, or Firm*—Finnegan, Henderson, Farabow, Garrett, & Dunner, L.L.P.

[57] ABSTRACT

A ploughshare (10) having cutting edges (2) and a securing device (4,5) for attachment to a plough (not shown). The ploughshare (10) has a number of individual metallic shares (6) which are firmly embedded in an elastomer mass 3. During use, each individual share (6) is independently moveable from the underlying surface against the elasticity in the mass (3) with a view to absorbing or adjusting itself to irregularities (wheel track wear) in the underlying surface. The share is mounted substantially vertical and is especially designed for equipment for clearing snow, slush and ice.

4 Claims, 1 Drawing Sheet

PLOUGHSHARE

FIELD OF THE INVENTION

The present invention relates to a ploughshare having cutting edges and securing means for attachment to a plough.

SUMMARY OF THE INVENTION

The ploughshare has been especially developed with a view to being mounted on a plough for clearing snow, slush and ice. The ploughshare will be particularly well-suited for clearing snow where road salt is used, such as is often the case in towns, and where grooves have been formed in the road surface owing to wear caused by studded tires.

The ploughshare is constructed such that it constitutes a replaceable part of a plough and the actual dismantling and mounting can take place quickly and by means of simple aids. Furthermore, the construction and material choice of the ploughshare give a very low noise level during use compared with other shares of a conventional design.

This is achieved with a ploughshare of the kind mentioned above which is characterised in that a number of single shares are firmly embedded in an elastomer mass, where, on use, each individual share is independently moveable from the underlying surface against the elasticity in the mass with a view to absorbing or adjusting itself to irregularities (wheel track wear) in the underlying surface.

It is of advantage if each individual share comprises a share plate having cutting edges of hardmetal attached thereto. The cutting edge may be bolted or welded onto the share plate. The cutting edge may be of a sintered material.

Advantageously, the share plate may be of a substantial U-shape which opens upward during use, where the opening partly encloses the securing means. The securing means themselves may comprise several metal bushes which are embedded in the elastomer mass and form a through-going bolt hole through the mass, and a metal rod which extends in the longitudinal direction of the share and has holes which correspond with the bolt holes of the bushes, and screw connections for clamping attachment of the ploughshare between the metal rod and the plough.

BRIEF DESCRIPTION OF THE DRAWINGS

Other, additional purposes, features and advantages will become clear in the following description of what is for the present a preferred embodiment of the invention, which is given for the purposes of description, without thereby being limiting, and given in connection with the attached drawings, where.

DETAILED DESCRIPTION OF THE PREFERRED EMBODIMENT

Figure 1:
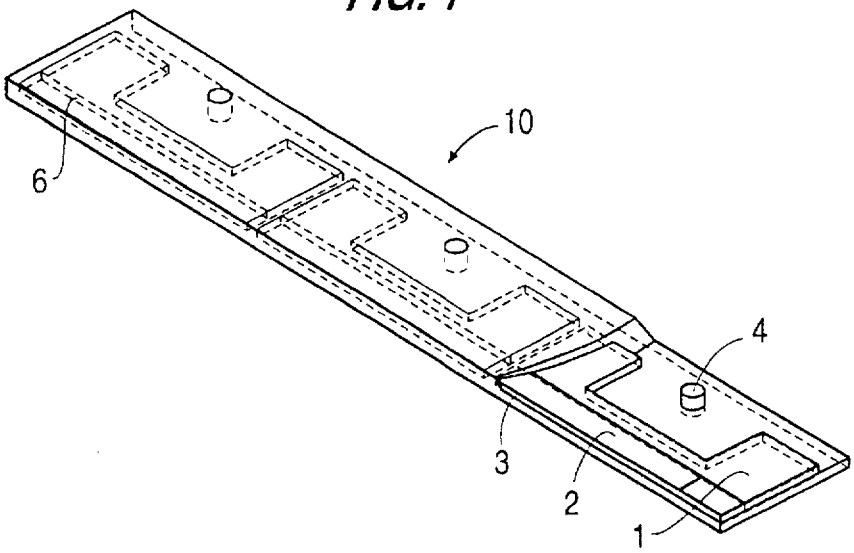
FIG. 1 is a schematic illustration in partial perspective view of a ploughshare according to the invention, where a portion has been removed to clarify details of the ploughshare.

Reference is first made to FIG. 1 which shows a ploughshare 10, designed to be mounted on a plough (not shown) by means of various securing means. The ploughshare 10 is constructed of several individual shares 6. The illustrated embodiment has three such individual shares 6. The number can, of course, vary according to need for each individual application. During manufacture, the individual shares are embedded in an elastomer mass, such as rubber of a certain firmness and rigidity. The elastomer mass 3 holds the individual shares 6 in place in a stable manner. Each individual share 6 consists of a share plate 1 and a cutting edge 2, preferably of hardmetal, such as a sintered material, which are firmly secured to one another, for example, by means of screw connections or by means of a weld. At the moment the ploughshare is put to use, the cutting edge 2 penetrates the elastomer mass, thereby becoming uncovered and comes into direct contact with the snow, slush and ice which are to be removed. When in use, the ploughshare will be substantially vertical to the road surface, although a certain degree of tilting will be possible.

The ploughshare 10 includes also a number of metal bushes 4 which are embedded in the elastomer mass 3 and thus form a through-going hole in the elastomer mass 3. At the same time, the metal bushes 4 function as spacer bushes.

Figure 2:
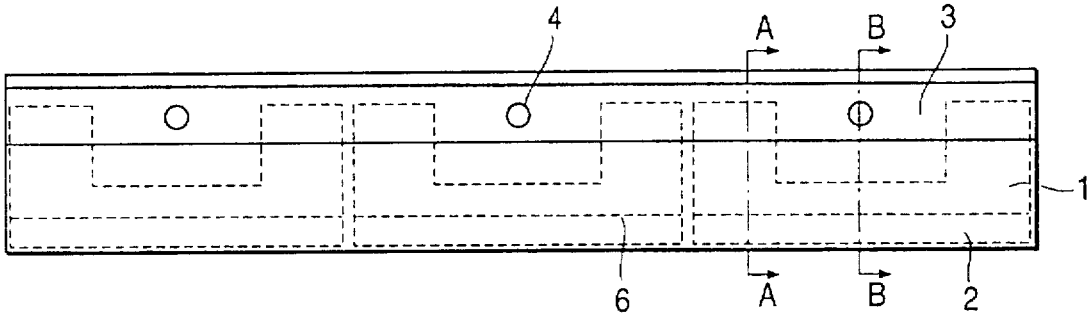
FIG. 2 is a schematic illustration of a top view of the ploughshare according to FIG. 1.

FIG. 2 shows more clearly how the individual shares 6 are positioned relative to one another. They are spaced slightly apart with the elastomer mass 3 therebetween. As can be seen from FIGS. 1 and 2, the share plate 1 has a substantial U-shape which during use faces upward and partly encloses the metal bush 4.

Figure 3A:
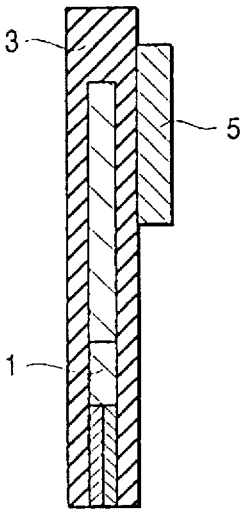
FIGS. 3*a* and 3*b* show respectively a section along line A—A and line B—B through the ploughshare according to FIG. 2.
Figure 3B:
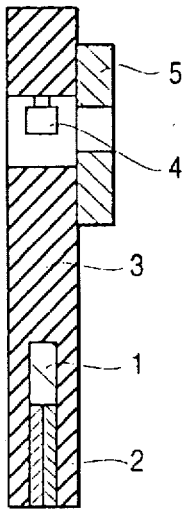

FIGS. 3*a* and 3*b* show respective sections through the ploughshare 3. During production the share plate 1 is completely embedded in the elastomer mass 3. When the ploughshare 10 is to be mounted on a plough, another securing means is used in the form of an elongated rod 5, e.g., a clamp iron in the form of a flat iron. Advantageously, the clamp iron extends the entire longitudinal extent of the ploughshare 10 and covers the metal bushes 4. At certain points, the clamp iron 5 has apertures which correspond with the holes in the metal bushes 4. On mounting the ploughshare 10 is clamped between the actual plough and the clamp iron 5 by means of screw connections (not shown) which are mounted through the apertures in the clamp iron 5 and the metal bushes 4 and to the plough itself.

By means of a mounting of this kind and the embedding of the individual shares 6 in the elastomer mass 3, the individual shares do not come into direct contact with either the plough or the clamp iron 5. The individual shares 6 are however held in place in a stable manner by means of this attachment. As they are embedded in the elastomer mass 3, each individual share 6 is given an independent, individual freedom of movement in the direction of elevation. There is also a certain degree of freedom for edging, i.e., each share 6 is able to slightly pivot around the longitudinal axis of the metal bush 4.

From the foregoing, it should be understood that the ploughshare is especially suited for absorbing irregularities in the underlying surface, such as wheel track wear in the road surface. Certain requirements for the quality of the elastomer mass are made with regard to rigidity and firmness. Preferably, the individual shares 6 are vulcanised to the elastomer mass 3 in such a way that the individual shares 6 do not fall out after use when the plough has to be lifted. This special construction also provides the advantage that the level of noise during use is extremely low compared with other shares of conventional construction.

I claim:

1. A ploughshare having cutting edges and securing means for attachment to a plough and a plurality of individual metallic shares firmly embedded in an elastomer mass lying between the individual shares and the securing means to enable elastic adjustment of the shares to irregularities in an underlying surface, wherein the individual shares and the elastomer mass project substantially from the securing means, each individual share is substantially vertically and tiltably resilient to be moveable relative to the underlying surface, and each share is substantially U-shaped to define a pair of legs and an upwardly directed opening partially enclosing a part of the securing means, the legs being movably secured by another part of the securing means.

2. The ploughshare of claim 1, wherein each individual share includes a share plate and cutting edge of hard metal secured thereto.

3. The ploughshare of claim 2, wherein the cutting edge is of a sintered material.

4. The ploughshare of claim 1, 2, or 3, wherein the securing means includes a plurality of metal bushes embedded in the elastomer mass, each of the metal bushes forming a bolt hole through the mass, a metal rod extending in the longitudinal direction of the share and across the metal bushes, the metal rod having apertures registering with the bolt holes in the metal bushes, and screw connections for clamping attachment of the ploughshare between the metal rod and the plough.

* * * * *